US010132326B2

(12) United States Patent
Kinzer

(10) Patent No.: US 10,132,326 B2
(45) Date of Patent: Nov. 20, 2018

(54) IMPELLER FOR AXIAL FANS

(71) Applicant: TLT-TURBO GMBH, Zweibrücken (DE)

(72) Inventor: Frank Kinzer, Merchweiler (DE)

(73) Assignee: TLT-TURBO GMBH, Zweibrücken (DE)

( * ) Notice: Subject to any disclaimer, the term of this patent is extended or adjusted under 35 U.S.C. 154(b) by 72 days.

(21) Appl. No.: 14/917,145

(22) PCT Filed: Jun. 16, 2015

(86) PCT No.: PCT/EP2015/001210
§ 371 (c)(1),
(2) Date: Mar. 7, 2016

(87) PCT Pub. No.: WO2015/197167
PCT Pub. Date: Dec. 30, 2015

(65) Prior Publication Data

US 2017/0122335 A1 May 4, 2017

(30) Foreign Application Priority Data

Jun. 24, 2014 (DE) ..... 10 2014 009 051

(51) Int. Cl.
*F04D 29/34* (2006.01)
*F04D 29/32* (2006.01)
*F04D 29/36* (2006.01)

(52) U.S. Cl.
CPC ..... *F04D 29/34* (2013.01); *F04D 29/329* (2013.01); *F04D 29/36* (2013.01)

(58) Field of Classification Search
CPC ..... F04D 29/322; F04D 29/329; F04D 29/34; B64C 11/00; B64C 11/02; B64C 11/04; B63H 3/12
See application file for complete search history.

(56) References Cited

U.S. PATENT DOCUMENTS 2,232,670 A * 2/1941 Barrett ..... F04D 29/36 416/207
2016/0245308 A1* 8/2016 Robertson ..... F01D 9/042

FOREIGN PATENT DOCUMENTS

DE 102006001909 A1 7/2007
GB 2390647 A 1/2004
WO 97/41355 A1 11/1997

OTHER PUBLICATIONS

International Search Report dated Sep. 10, 2015 issued in PCT/EP2015/001210.

* cited by examiner

*Primary Examiner* — Logan Kraft
*Assistant Examiner* — Elton Wong
(74) *Attorney, Agent, or Firm* — Kilpatrick Townsend & Stockton LLP

(57) ABSTRACT

The invention relates to an impeller for an axial fan, having an impeller body, which has an outer impeller shell and a carrier disc having a hub for connection for conjoint rotation to a drive shaft. A multiplicity of radially outward-pointing blades, which each have a blade root and a vane, is arranged on the carrier disc. Each blade root has a fastening portion accommodated with positive engagement between two fastening segments each arranged opposite one another on both sides of the carrier disc. The two opposite fastening segments and the carrier disc each have at least two through-holes for accommodating a long sleeve and a short sleeve. The fastening portion can be clamped firmly between the two opposite fastening segments with the aid of screw bolts, in each case inserted through the sleeves, and nuts, wherein each blade root is guided in a respective recess of the carrier disc.

8 Claims, 3 Drawing Sheets

IMPELLER FOR AXIAL FANS

CROSS REFERENCE TO RELATED APPLICATIONS

This application is a U.S. National Stage of International Application No. PCT/EP2015/001210, filed Jun. 16, 2015, which claims the benefit of German patent Application No. 10 2014 009 051.5, filed Jun. 24, 2014, the entire contents of which are incorporated herein by reference.

PRIOR ART

The invention relates to an impeller for an axial fan, having an impeller body, which has an outer impeller shell and a carrier disc having a hub for connection for conjoint rotation to a drive shaft, wherein a multiplicity of radially outward-pointing blades, which each have a blade root and a vane, is arranged on the carrier disc.

Axial ventilators are widely used in the industry. In many cases, an impeller for an axial ventilator comprises an impeller body, a plurality of radially outward-pointing blades and elements for fastening the blades on the impeller body. Moreover, an inlet shroud fastened on the impeller body is often provided to reduce turbulence. Among the components of the impeller body are an outer impeller casing to guide the flow, a carrier disc and a hub for coupling for conjoint rotation to a drive shaft. The impeller body can be of integral construction and, in this case, can be produced by welding, casting or forging, for example. Moreover, the impeller body can also be of multi-part construction, having individual components fastened by screws, for example. As components with a primarily aerodynamic action, the blades generally comprise a vane and a blade root for fastening on the impeller body. A very wide variety of production methods, e.g. forging, casting, pressing or even milling, may also be considered for the blades.

An impeller for an axial ventilator or an axial fan is known from DE 10 2006 001 909 B4.

The impeller of the axial ventilator comprises a cylindrical carrier disc and a multiplicity of blades, which each have a blade root and a vane. A pair of clamping jaws is provided for the mechanically fixed clamping of each blade. For this purpose, the clamping jaws of each pair of clamping jaws are arranged on both sides of the carrier disc and are screwed to the latter. As regards their configuration, all the clamping jaws are identical in as much as they are completely interchangeable. In its radially outward-oriented region, each clamping jaw merges into a radially outward-facing skirt. On each side of the impeller, the partially overlapping skirts jointly form an encircling hub ring to optimize flow guidance. During the assembly of this previously known impeller, the blades can furthermore be turned about their longitudinal axis before being firmly clamped in a receiving nest defined by the clamping jaws by tightening through-bolts and nuts, thus allowing the angle of attack of each blade to be freely defined. Two distance pieces and a clamping sleeve are furthermore mounted on each through-bolt.

A disadvantage with this embodiment is that the clamping jaws are embodied as pressings, castings or forgings with a relatively complex three-dimensional geometry.

It is therefore the object of the invention to indicate an impeller for an axial fan which can be manufactured at low cost while using primarily standard components of simple shape.

Disclosure of the Invention

A disclosure is made of an impeller for an axial fan, having an impeller body, which has an outer impeller shell and a carrier disc having a hub for connection for conjoint rotation to a drive shaft, wherein a multiplicity of radially outward-pointing blades, which each have a blade root and a vane, is arranged on the carrier disc.

According to the invention, each blade root has a fastening portion, which is accommodated with positive engagement between two trapeziform, triangular or rectangular fastening segments each arranged opposite one another on both sides of the carrier disc, and the in each case two opposite fastening segments and the carrier disc each have at least two through-holes for accommodating a short sleeve and a long sleeve, and the fastening portion can be clamped firmly between in each case two opposite fastening segments with the aid of screw bolts, in each case inserted through the sleeves, and nuts, wherein each blade root is guided in a respective recess of the carrier disc.

By virtue of this design configuration, the impeller can be manufactured using components which are relatively simple and are therefore less expensive to produce. Moreover, manufacture of the blade roots is simpler, in particular. The invention furthermore makes it possible to reduce the number of different components by largely using common parts, even in the case of different sizes of impeller. Moreover, a significant reduction in weight is obtained in comparison with conventional designs. The sleeves serve inter alia to introduce the high radial forces into the carrier disc, which does not necessarily have to be embodied as a disc but can also be embodied as a spoked structure or the like, for example. The recesses each have a rectangular shape. Accordingly, the carrier disc has a radially outward-oriented, trapeziform material region or peripheral contour similar to that of a gearwheel between each pair of adjacent blade roots.

In the case of an advantageous development, it is envisaged that there is at least one axial gap between in each case two opposite fastening segments and the carrier disc. According to a development, the sleeves each have a collar at one end. These are preferably a short sleeve and a sleeve of longer design, which each have a collar at one end. The short and long sleeves are inserted positively into the fastening elements and the carrier disc, but the collar of the short and the long sleeve is not inserted positively in its centering.

Axial delimitation of the position of the sleeve in the through-holes is thereby obtained, at at least one end. Moreover, only two additional parts have to be installed for each through-hole or each screw bolt with nut.

In an advantageous embodiment, each blade root is guided in a hole in the impeller shell.

The fixing of the position of the blades on the impeller body is thereby improved.

In the case of another embodiment, there is an annular gap between shanks of each long sleeve and each short sleeve. It is thereby possible to compensate for tolerances which arise in the course of manufacture. If appropriate, the axial gap between the carrier disc and the fastening segment can be reduced almost to zero.

According to another advantageous embodiment, a shank length of each first sleeve is significantly greater than a shank length of each second sleeve.

As a result, a simple visual check on the installation position of the sleeve from one side of the carrier disc is possible, at least in the case of the longer sleeve, and there is furthermore uniform transmission of the centrifugal forces on the blades to both fastening segments.

In a technically advantageous development, in each case two opposite fastening segments cover in each case one recess of the carrier disc with a fastening portion, in each case guided therein, of a blade. In combination with the sleeves, particularly reliable fixing of the position of the blades on the carrier disc in a manner which is resistant to high mechanical loads is thereby possible.

In an advantageous development, each fastening portion of a blade root is a cylinder having at least one annular groove running around the circumference.

As a result, it is possible during installation to turn the blades initially by any angle about their longitudinal axis before final clamping, thus enabling the angle of attack of the blades and hence the flow rate of a medium through the axial fan to be influenced. Moreover, such a cylinder geometry is easy to manufacture.

BRIEF DESCRIPTION OF THE DRAWINGS

The invention will be described in greater detail below by means of the drawing, in which.

EMBODIMENTS

Figure 1:
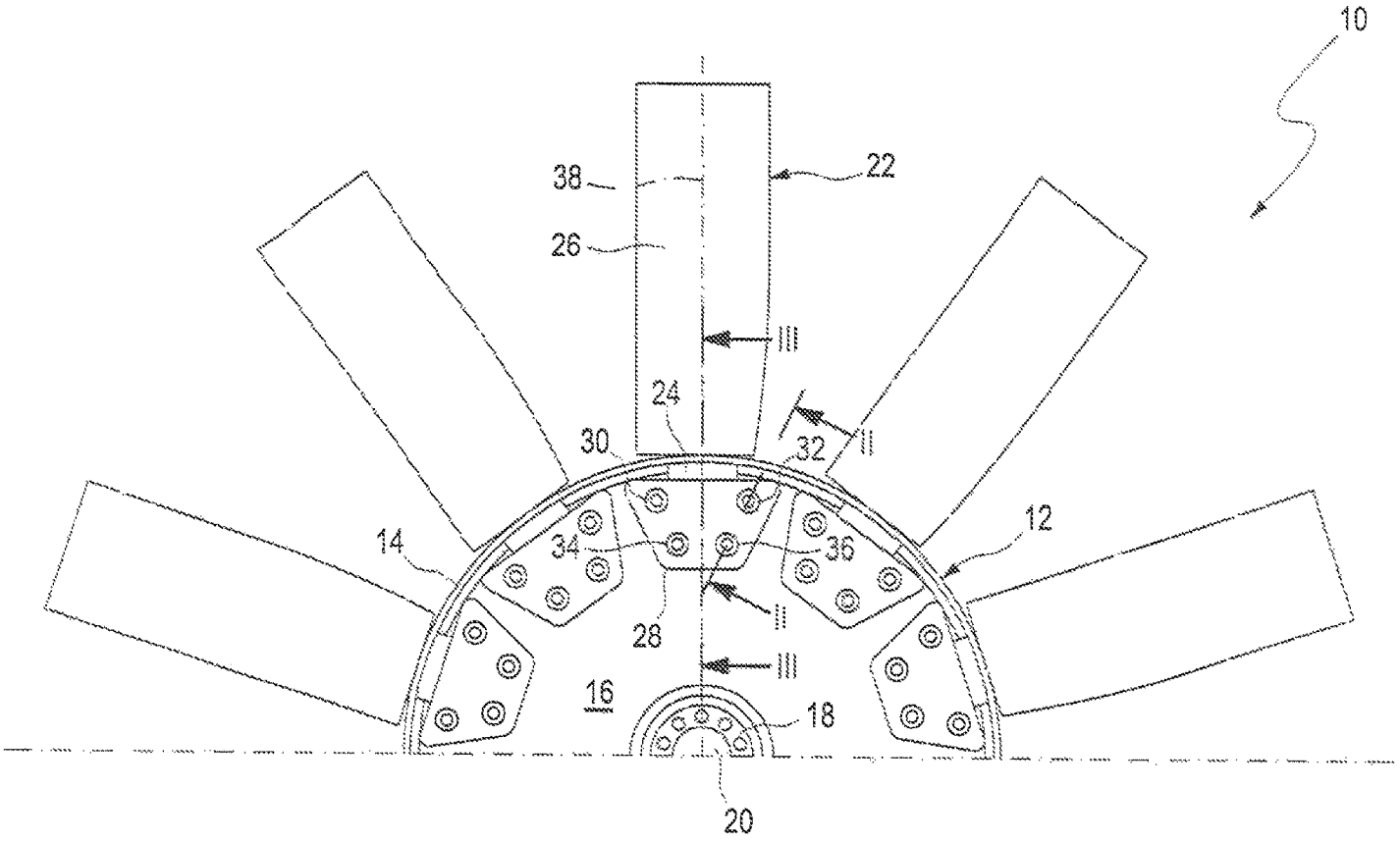
FIG. 1 shows a plan view of a detail of an impeller according to the invention for an axial fan.

FIG. 1 shows a plan view of a detail of an axial fan impeller according to the invention.

The impeller 10 for an axial fan or axial ventilator (not shown) has inter alia an impeller body 12 having an outer impeller shell 14 and a carrier disc 16. A hub for connection for conjoint rotation to a drive shaft 20 is arranged centrally on the substantially disc-shaped or cylindrical carrier disc 16 of the impeller body 12. Fastened on the carrier disc 16 is a multiplicity of blades, of which one blade is provided representatively with the reference 22. The blade 22 has a blade root 24 and a vane 26. The blade root 24 of the blade 22, like that of all the other blades, is clamped firmly between two trapeziform, rectangular or triangular fastening segments fastened opposite one another on the carrier disc 16, only a front trapeziform, rectangular or even triangular fastening segment 28 being visible here. The mechanical clamping of the in each case two fastening segments positioned opposite one another on the carrier disc 16 and the connection of said segments to the carrier disc 16 is accomplished with the aid of at least two screw bolts 30 to 36 and nuts (also situated in a concealed position here). Before the clamping of the fastening segments, the blade 22 can in each case be pivoted freely about its axis of rotation 38, as can all the others, thus making it possible to set optimum angles of attack of the blades 22 of the impeller 10 for different usage scenarios.

Figure 2:
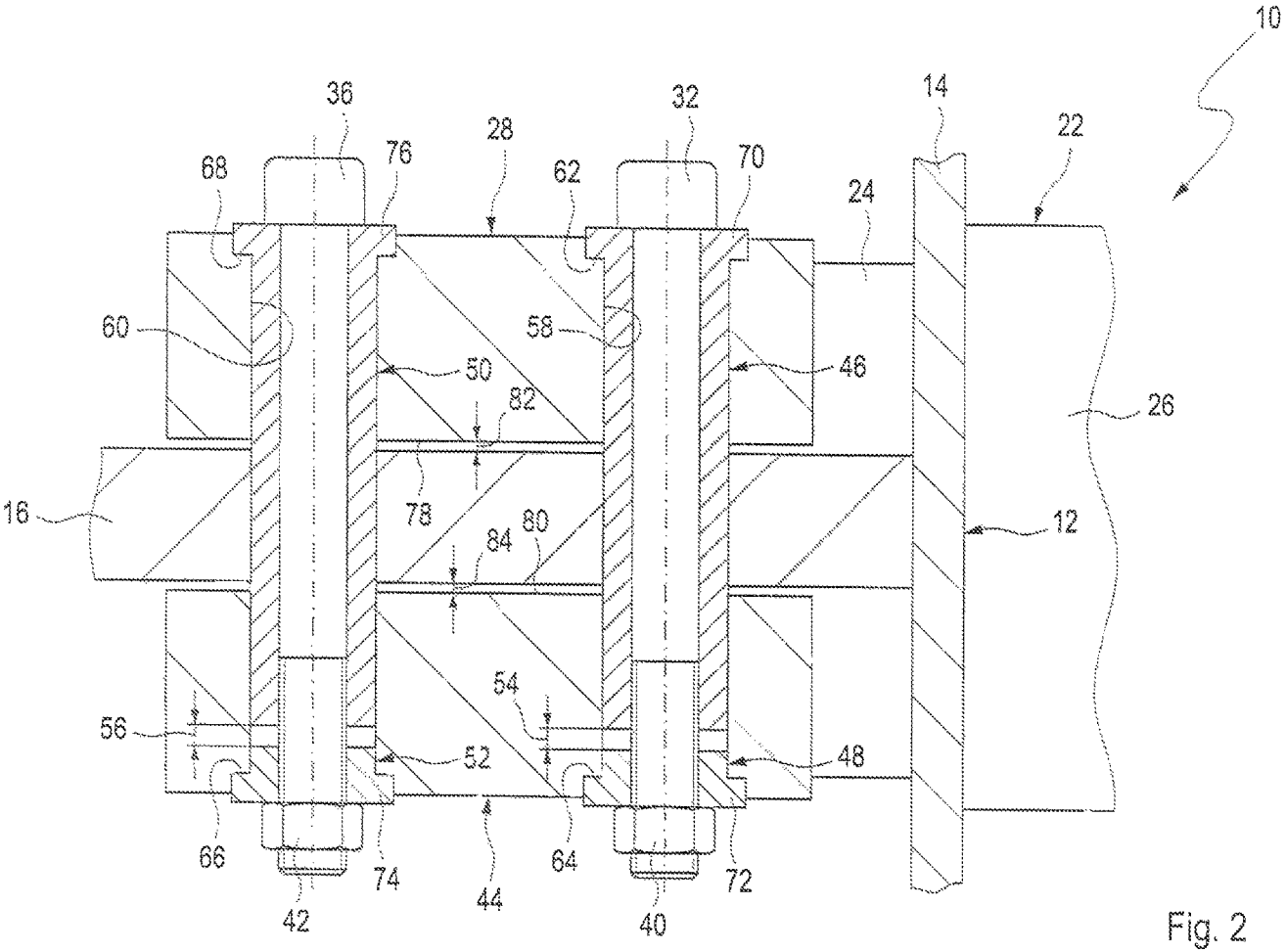
FIG. 2 shows a cross section along section line II-II in FIG. 1.

FIG. 2 illustrates a cross section along section line II-II in FIG. 1.

Fastening segment 28 is clamped to another fastening segment 44 arranged opposite it on the carrier disc 16 and connected to the carrier disc 16 by means of the screw bolts 32, 36 and the nuts 40, 42 screwed onto said bolts. The same applies to the screw bolts 30, 34 (concealed here) with the associated nuts thereof. Extending above the two fastening segments 28, 44 is the blade root 24 of the blade 22, said root being clamped between the fastening segments 28, 44.

Each screw bolt 32, 36 is accommodated respectively in a long sleeve 46 and a short sleeve 48 and a further long sleeve 50 and a further short sleeve 52, the shanks of which, which are not designated for the sake of greater clarity in the drawing, are separated respectively by an annular gap 54, 56. The sleeves 46 to 52 each have a hollow-cylindrical shape and the annular gaps 54, 56 can also have a width of approximately zero.

The shank length (likewise not designated) of the long sleeves 46, 50 is substantially greater than a shank length of the short sleeves 48, 52. The sleeves 46 to are accommodated respectively in a cylindrical through-hole 58, 60, which passes completely through the two fastening segments 28, 44 and the carrier disc 16. A radial clearance between the sleeves 46 to 52 and the through-holes 58, 60 is preferably of the order of zero. If appropriate, a slight interference fit can also be provided. The through-holes 58, 60 can each have cylindrical counterbores 62 to 68, in which the sleeves 46 to 52 are accommodated. A collar 70, 72, 74 or 76, respectively, of the sleeves 46 to 52 is not accommodated with positive engagement, only the shanks of the sleeves 46 to 52 being so accommodated. In this arrangement, the counterbores 62 to 68 are each introduced into upper sides (not designated) of the two fastening segments 28, 44, said upper sides facing away from the carrier disc 16. Here, by way of example, there is in each case an axial gap 82, 84 between the inner sides 78, 80 of the two fastening segments 28, 44 and the carrier disc 16, said axial gap in each case being significantly smaller than the annular gaps 54, 56 between the long and the short sleeve 46, 48 and between the further long and the further short sleeve 50, 52. The sleeves 46 to 52 serve primarily to absorb the high centrifugal forces which act on the blades in axial fans, while the collars 70, 72, 74, 76 perform a similar function for the heads of screw bolts and the nuts as conventional, separate washers.

In a manner corresponding to the above-explained structure, the screw bolts (concealed here) and all the other screw bolts are inserted into sleeves of the same design configuration. It is important that the fastening segments 28, 44 do not necessarily rest against the carrier disc 16—i.e. both axial gaps 82, 84 are greater than zero in this configuration—but can do so.

Figure 3:
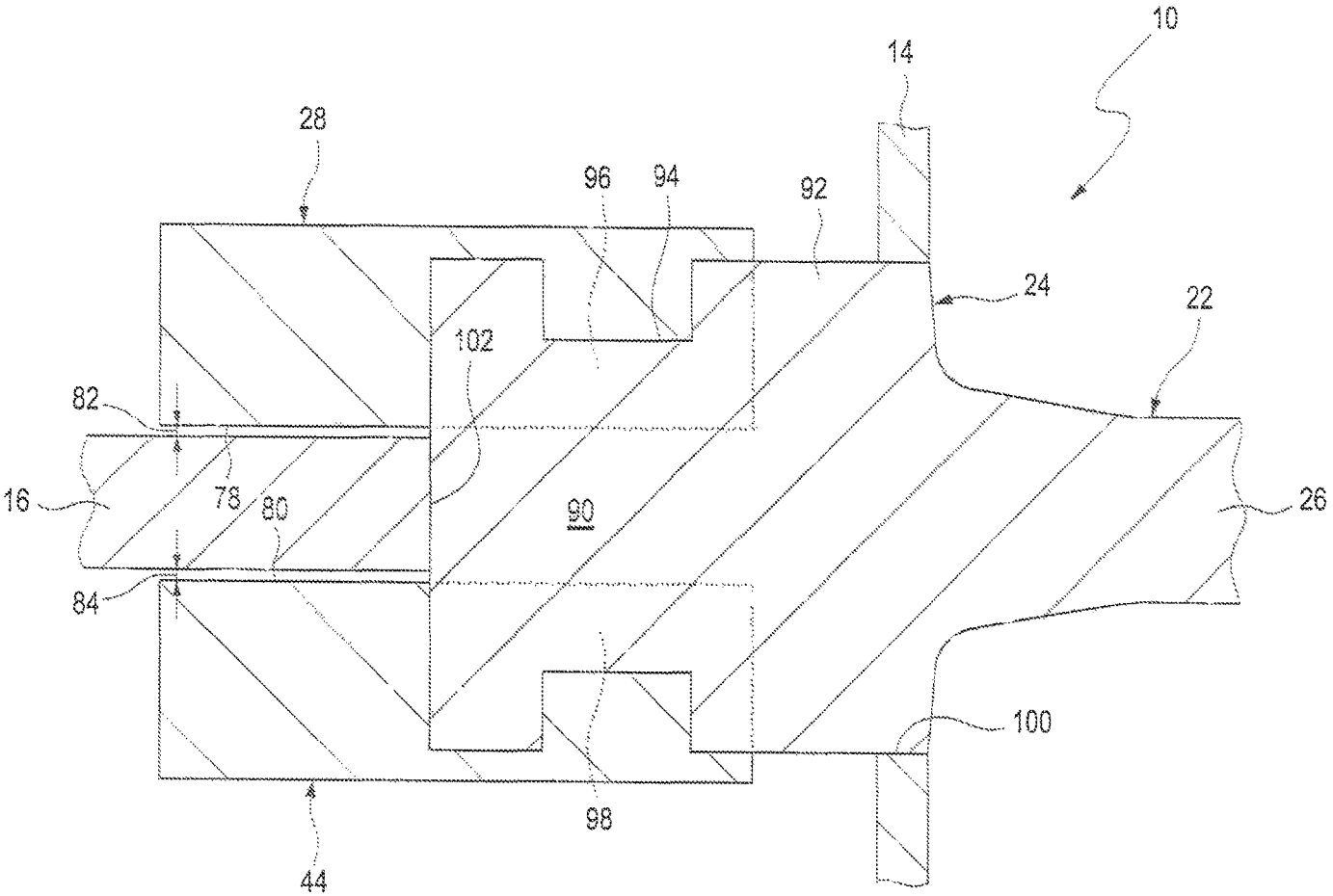
FIG. 3 shows a cross section along section line III-III in FIG. 1.

FIG. 3 shows a cross section along section line III-III in FIG. 1.

The blade root 24, which is preferably formed integrally on the underside of the vane 26 of the blade 22, has a contoured fastening portion 90. The contoured fastening portion 90 is shaped as a cylinder 92 with an annular groove 94 recessed into said cylinder, which runs around the circumference. Each fastening segment 28, 44 has a recess 96, 98, symbolized by a dotted line, in which the fastening portion 90 is accommodated with an accurate positive fit. By tightening the screw bolts (cf. FIGS. 1 and 2), the fastening segments 28, 44 are clamped mechanically to the contoured fastening portion 90 of the blade root 24, thereby giving rise, in interaction with the positive engagement and the sleeves 46 to 52, to fastening of the blade 22 on the carrier disc 16 which is mechanically extremely reliable.

A hole 100 for the passage of the fastening portion 90 of the blade root 24 is introduced into the impeller shell 14. An approximately rectangular recess 102, which is necessary to accommodate the blade root 24, is introduced into the carrier disc 16 underneath the blade root 24. Accordingly, a circumferential contour of the carrier disc 16 is designed in a manner resembling a gearwheel, such that a radially outward-oriented trapeziform material region remains between each pair of adjacent recesses. Both the hole 100 and the recess 102 serve to optimize the guidance of the blade 22 on the carrier disc 16. Once again, there are the axial gaps 82, 84 between the inner sides 78, 80 of the two fastening segments 28, 44 and the carrier disc 16. The other blades of the impeller 10, which are not designated or not shown, are connected to the carrier disc 16 in the same way.

The invention claimed is:

1. An impeller for an axial fan, having an impeller body, which has an outer impeller shell and a carrier disc having a hub for connection for conjoint rotation to a drive shaft, wherein a multiplicity of radially outward-pointing blades, which each have a blade root and a vane, is arranged on the carrier disc, characterized in that each blade root has a fastening portion which is accommodated with positive engagement between two fastening segments each arranged opposite one another on both sides of the carrier disc, and the two opposite fastening segments of each fastening portion and the carrier disc each have at least two through-holes, each through-hole accommodating a short sleeve having a shank and a long sleeve having a shank, and the fastening portion is can be clamped firmly between the two opposite fastening segments of each fastening portion with the aid of screw bolts, inserted through the respective sleeves, and nuts, wherein each blade root is guided in a respective recess of the carrier disc, and wherein a shank length of each long sleeve is significantly greater than a shank length of each short sleeve.

2. The impeller according to claim 1, wherein there is at least one axial gap between the two opposite fastening segments of each fastening portion and the carrier disc.

3. The impeller according to claim 1, wherein in each case the two opposite fastening segments of each fastening portion rest on the carrier disc without a gap.

4. The impeller according to claim 1, wherein the short sleeves and the long sleeves each have a collar at one end, the shanks being accommodated positively, at least in some region or regions, in one of the through-holes in the fastening segments of each fastening portion.

5. The impeller according to claim 1, wherein each blade root is guided in a hole in the impeller shell.

6. The impeller according to claim 1, wherein there is an annular gap between shanks of each long sleeve and each short sleeve.

7. The impeller according to claim 1, wherein two opposite fastening segments of each fastening portion cover one recess of the carrier disc.

8. The impeller according to claim 1, wherein each fastening portion of the respective blade root is a cylinder having at least one annular groove running around the circumference of the blade root.

* * * * *